US005467836A

United States Patent [19]

Grimes et al.

[11] Patent Number: 5,467,836

[45] Date of Patent: * Nov. 21, 1995

[54] FIXED CUTTER BIT WITH SHEAR CUTTING GAGE

[75] Inventors: Robert E. Grimes, Cypress; Danny E. Scott, The Woodlands; Rudolf C. O. Pessier, Houston, all of Tex.

[73] Assignee: Baker Hughes Incorporated, Houston, Tex.

[ * ] Notice: The portion of the term of this patent subsequent to Jan. 31, 2012, has been disclaimed.

[21] Appl. No.: 300,502

[22] Filed: Sep. 2, 1994

Related U.S. Application Data

[63] Continuation-in-part of Ser. No. 169,880, Dec. 17, 1993, Pat. No. 5,346,026, which is a continuation-in-part of Ser. No. 830,130, Jan. 31, 1992, Pat. No. 5,287,936.

[51] Int. Cl.[6] ..... E21B 10/46; E21B 12/04

[52] U.S. Cl. ..... 175/401; 175/408; 175/426

[58] Field of Search ..... 175/229, 331, 175/341, 374, 376, 414, 426, 431, 401, 406, 408; 76/108.2

[56] References Cited

U.S. PATENT DOCUMENTS

| | | | |
|---|---|---|---|
| Re. 32,036 | 3/1984 | Dennis | 175/329 |
| 2,774,571 | 12/1956 | Morlan | 255/347 |
| 3,137,355 | 6/1964 | Schumacher | 175/374 |
| 3,153,458 | 10/1964 | Short | 175/329 |
| 3,158,216 | 11/1964 | Baron et al. | 175/426 X |
| 3,258,077 | 6/1966 | Phipps | 175/426 X |
| 3,389,761 | 6/1968 | Ott | 175/374 |
| 3,461,983 | 9/1969 | Hudson et al. | 175/375 |
| 3,858,671 | 1/1975 | Kita et al. | 175/410 |
| 3,922,038 | 11/1975 | Scales | 208/8.2 |
| 3,948,330 | 4/1976 | Langford, Jr. | 175/339 |
| 4,058,177 | 11/1977 | Langford et al. | 175/374 |
| 4,091,884 | 5/1978 | Thomas | 175/426 |
| 4,109,737 | 8/1978 | Bovenkerk | 175/329 |
| 4,140,189 | 2/1979 | Garner | 175/329 |
| 4,298,079 | 11/1981 | Norlander et al. | 175/339 |
| 4,301,877 | 11/1981 | Cloud | 175/340 |
| 4,359,335 | 11/1982 | Garner | 75/208 R |
| 4,499,795 | 2/1985 | Radtke | 175/426 X |
| 4,552,231 | 11/1985 | Pay et al. | 175/330 |
| 4,586,574 | 5/1986 | Grappendorf | 175/329 |
| 4,624,329 | 11/1986 | Evans et al. | 175/374 |
| 4,690,228 | 9/1987 | Voelz et al. | 175/24 |
| 4,694,918 | 9/1987 | Hall | 175/329 |
| 4,729,440 | 3/1988 | Hall | 175/107 |
| 4,738,322 | 4/1988 | Hall et al. | 175/329 |
| 4,832,139 | 5/1989 | Minikus et al. | 175/374 |
| 4,858,707 | 8/1989 | Jones et al. | 175/329 |
| 4,940,099 | 6/1990 | Deane et al. | 175/374 |

(List continued on next page.)

OTHER PUBLICATIONS

"Smith Steerable–Motor Bits on Target for Your Drilling Program," Promotional Brochure, Smith International, Inc.

*Primary Examiner*—Frank S. Tsay
*Attorney, Agent, or Firm*—Robert A. Felsman; Mark D. Perdue

[57] ABSTRACT

An earth-boring bit of the fixed cutter variety is provided with hard gage inserts that protrude from the gage surface of the cutter to engage the side of the borehole for holding gage. The gage insert has a substantially flat, polygonal face defining at least a pair of sharp cutting edges and at least a pair of cutting surfaces that define a negative rake angle with respect to the sidewall of the borehole that is being sheared by the gage insert. The face, cutting edge, and cutting surface of the gage insert are formed of a super-hard and abrasion-resistant material such as polycrystalline diamond or cubic boron nitride. The body of the insert is formed of a hard, fracture-tough material such as cemented tungsten carbide. The improved gage inserts provide an actively cutting gage surface that engages the sidewall of the borehole to promote shearing removal of the sidewall material. Such an improved gage insert provides an earth-boring bit with improved gage-holding ability, and improved steerability in directional drilling operations.

24 Claims, 4 Drawing Sheets

U.S. PATENT DOCUMENTS

| | | | |
|---|---|---|---|
| 4,982,802 | 1/1991 | Warren et al. | 175/57 |
| 4,984,643 | 1/1991 | Isbell et al. | 175/341 |
| 5,025,874 | 6/1991 | Barr et al. | 175/329 |
| 5,033,559 | 7/1991 | Fischer | 175/329 |
| 5,033,560 | 7/1991 | Sawyer et al. | 175/410 |
| 5,145,016 | 9/1992 | Estes | 175/331 |
| 5,154,245 | 10/1992 | Waldenstrom et al. | 175/420.2 |
| 5,163,524 | 11/1992 | Newton, Jr. et al. | 175/408 |
| 5,186,268 | 2/1993 | Clegg | 175/399 |

FIXED CUTTER BIT WITH SHEAR CUTTING GAGE

BACKGROUND OF THE INVENTION

This is a continuation-in-part of application Ser. No. 08/169,880, filed Dec. 17, 1993, now U.S. Pat. No. 5,346,026, which is a continuation-in-part of application Ser. No. 07/830,130, filed Jan. 31, 1992, now U.S. Pat. No. 5,287,936.

FIELD OF THE INVENTION

This invention relates to earth-boring bits, specifically to the hard inserts for use in such bits.

SUMMARY OF THE PRIOR ART

Earth-boring bits of the rolling cone variety rely on the rolling movement of at least one cutter over the bottom of the bore hole for achieving drilling progress. The earth-disintegrating action of the rolling cone cutter is enhanced by providing the cutter with a plurality of protrusions or teeth. These teeth are generally of two types: milled teeth, formed from the material of the rolling cone; and inserts, formed of a hard material and attached to the rolling cone surface. Earth-boring bits of the fixed cutter variety, commonly referred to as drag bits, have no moving parts and employ an array of hard inserts to scrape and shear formation material as the bit is rotated in the borehole.

One measure of an earth-boring bit's performance is its ability to "hold gage," or maintain a consistent borehole diameter over the depth or length of the borehole. Maintenance of a consistent borehole diameter expedites and simplifies the drilling process because drill strings may be removed from and inserted into a hole of generally consistent diameter more easily than a borehole of varying diameter. Gage-holding ability is of particular importance in directional drilling applications. For the same reasons, gage-holding ability also is of importance in earth-boring bits of the drag or fixed cutter variety.

To achieve this gage-holding ability, the rolling cones of such earth boring bits have been provided with hard inserts on the outermost, or gage, surface of the rolling cones. These gage inserts have functioned primarily as wear pads that prevent the erosion of the gage surface of the rolling cone, thereby permitting the earth boring bit to hold a more consistent gage or borehole diameter. One example of such an insert is disclosed in U.S. Pat. No. 2,774,571, Dec. 18, 1956, to Morlan. Other gage inserts are shown in U.S. Pat. No. 3,137,335, Jun. 16, 1964, to Schumacher; U.S. Pat. No. 3,389,761, Jun. 25, 1968, to Ott; and U.S. Pat. No. 4,729,440, Mar. 8, 1988, to Hall.

Two staggered rows of such gage inserts are disclosed in U.S. Pat. No. 4,343,372, Aug. 10, 1982, to Kinzer. U.S. Pat. No. 4,940,099, Jul. 10, 1990, to Deane et al., discloses alternating polycrystalline diamond and tungsten carbide gage inserts mounted substantially flush with the gage surface of the rolling cone cutter.

The gage inserts described in the above references are passive in operation, that is, they serve only as wear-resistant inserts and are not designed to actively cut the gage of the borehole. Such wear-resistant inserts are susceptible to heat-cracking and spalling in operation, and may fail to provide adequate gage-holding ability. Loss of gage-holding ability or gage protection can lead to lower rates of penetration and decreased seal and bearing life in rolling cutter bits. Earth-boring bits of the drag or fixed cutter variety also rely on passive diamond or tungsten carbide wear-resistant portions embedded in the gage surface of the bit to prevent erosive wear of the gage of the bit and to maintain gage. Examples of such gage inserts are found in U.S. Pat. No. 4,552,231, Nov. 12, 1985 to Pay et al; U.S. Pat. No. 4,586,574, May 6, 1986 to Grappendorf; U.S. Pat. No. 5,033,599, Jul. 23, 1992 to Fischer; and U.S. Pat. No. 5,033,500; Jul. 6, 1991 to Sawyer et al.

A Smith International, Inc. promotional brochure entitled "Smith Steerable-Motor Bits On Target For Your Drilling Program" discloses chisel-shaped inserts on the gage surface of the cutters of a rolling cutter bit that protrude a great distance from the gage surface. Similarly, U.S. Pat. No. 4,109,737 discloses a fixed cutter bit having hemispherical inserts projecting a large distance from the gage surface. It is believed that these inserts may be easily broken due to bending stress present in the inserts because of their extreme protrusion. It is further believed that rounded cutting edges associated with chisel-shaped and hemispherical inserts are susceptible to heat-cracking and spalling similar to passive wear-resistant inserts. Chisel-shaped and hemispherical inserts also provide less wear-resistance than flat-tipped inserts because only the rounded chisel crest is in tangential contact with the wall of the borehole.

SUMMARY OF THE INVENTION

It is a general object of this invention to provide an earth-boring bit having improved gage-holding ability.

This and other objects are achieved by an earth-boring bit of the fixed cutter variety provided with hard gage inserts that protrude from the gage surface of the bit to engage the side of the borehole for holding gage. The gage insert has a substantially flat, abrasion-resistant face, at least one sharp cutting edge and at least one cutting surface that defines a negative rake angle with respect, to the sidewall of the borehole that is being sheared by the gage insert. The face, cutting edge, and cutting surface of the gage insert are formed of a super-hard and abrasion-resistant material such as polycrystalline diamond or cubic boron nitride. The body of the insert is formed of a hard, fracture-tough material such as cemented tungsten carbide.

The improved gage inserts provide an actively cutting gage surface that engages the sidewall of the borehole to promote shearing removal of the sidewall material. Such an improved gage insert provides an earth-boring bit with improved gage-holding ability, and improved steerability in directional drilling operations.

The above and additional objects, features, and advantages of the invention will be apparent from the following detailed description of the invention.

DETAILED DESCRIPTION OF THE INVENTION

Figure 1:
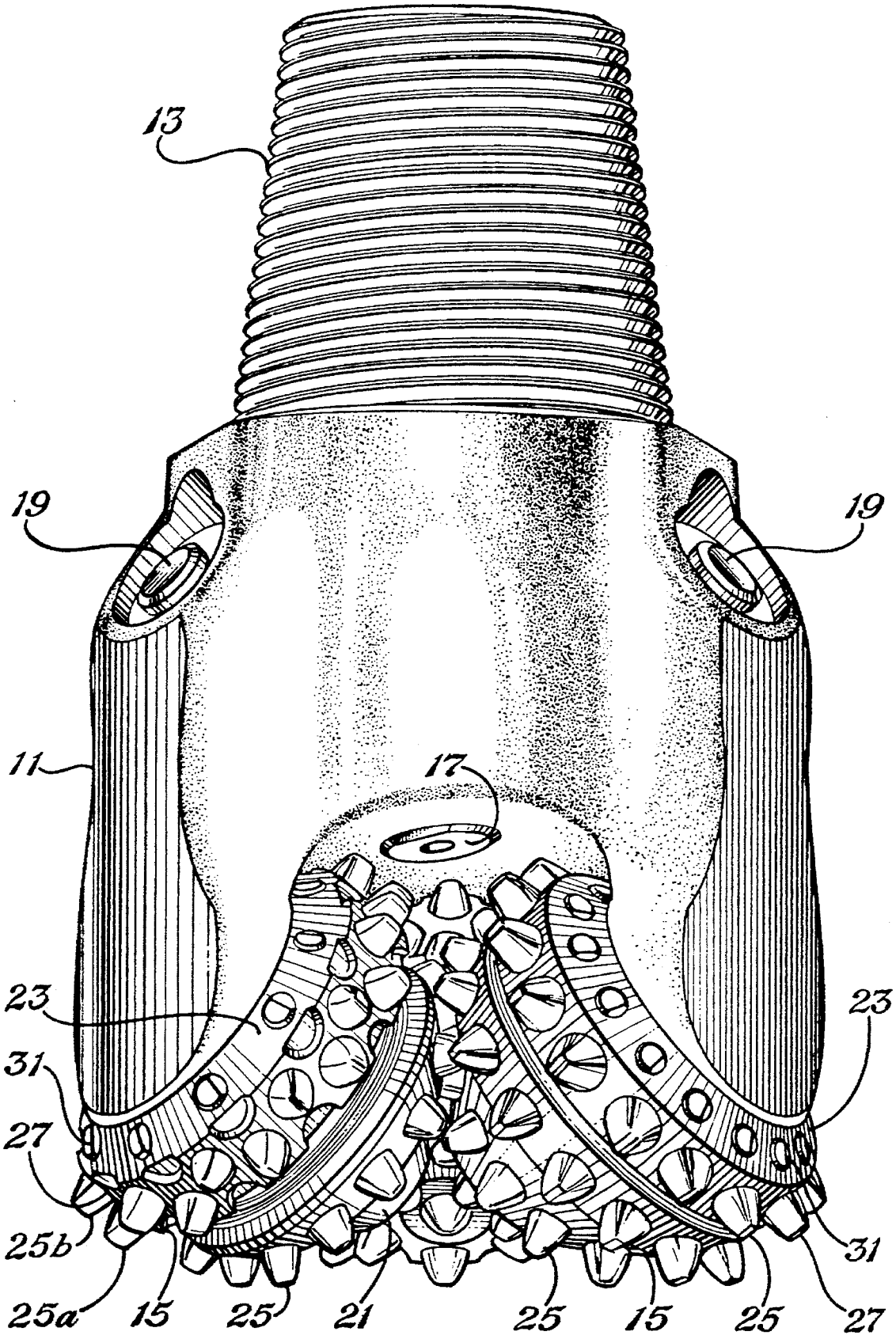
FIG. 1 is a perspective view of an earth-boring bit that embodies the improved gage inserts of the invention.

Referring to FIG. 1, an earth-boring bit 11 has a threaded section 13 on its upper end for securing the bit to a string of drill pipe. A plurality of earth-disintegrating cutters 15, usually three, are rotatably mounted on bearing shafts (not shown) depending from the bit body. At least one nozzle 17 is provided to discharge drilling fluid pumped from the drill string to the bottom of the borehole. A lubricant pressure compensator system 19 is provided for each cutter to reduce a pressure differential between the borehole fluid and the lubricant in the bearings of the cutters 15.

Each cutter 15 is generally conical and has nose area 21 at the apex of the cone, and a gage surface 23 at the base of the cone. The gage surface 23 is frusto-conical and is adapted to contact the sidewall of the borehole as the cutter 15 rotates about the borehole bottom. Each cutter 15 has a plurality of wear-resistant inserts 25 secured by interference fit into mating sockets drilled in the supporting surface of the cutter 15. These wear-resistant inserts 25 are constructed of a hard, fracture-tough material such as cemented tungsten carbide. Inserts 25 generally are located in rows extending circumferentially about the generally conical surface of the cutters 15. Certain of the rows are arranged to intermesh with other rows on other cutters 15. One or two of the cutters may have staggered rows consisting of a first row of **25*a* of inserts and a second row of 25*b* of inserts. A first or heel row 27 is a circumferential row that is closest to the edge of the gage surface 23. There are no inserts closer to the gage surface 23 than the inserts of the heel row 27. A row of gage inserts 31 according to the present invention are secured to the gage surface 23 of the cutter 15**.

Figure 2:
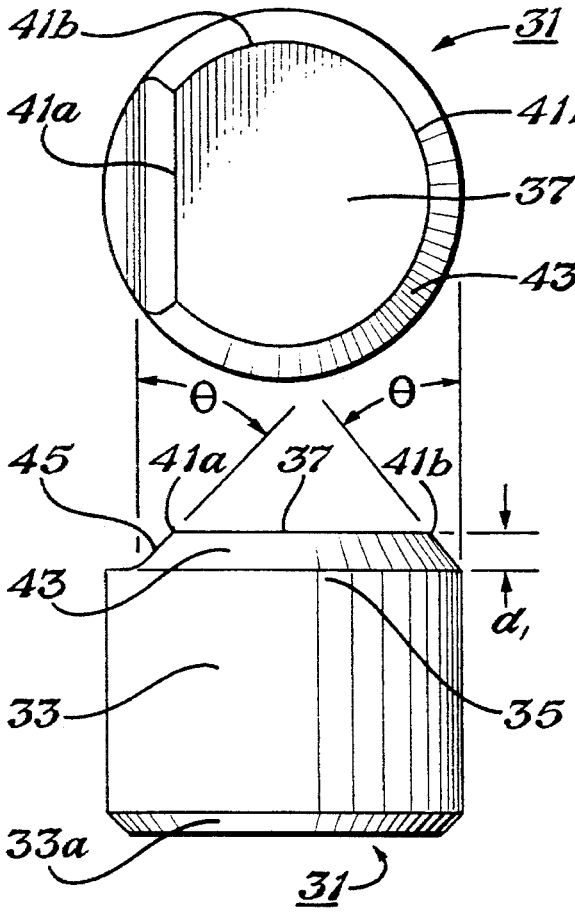
FIG. 2 is an enlarged, plan, and side elevation view of an embodiment of the gage insert of the present invention.
Figure 3:
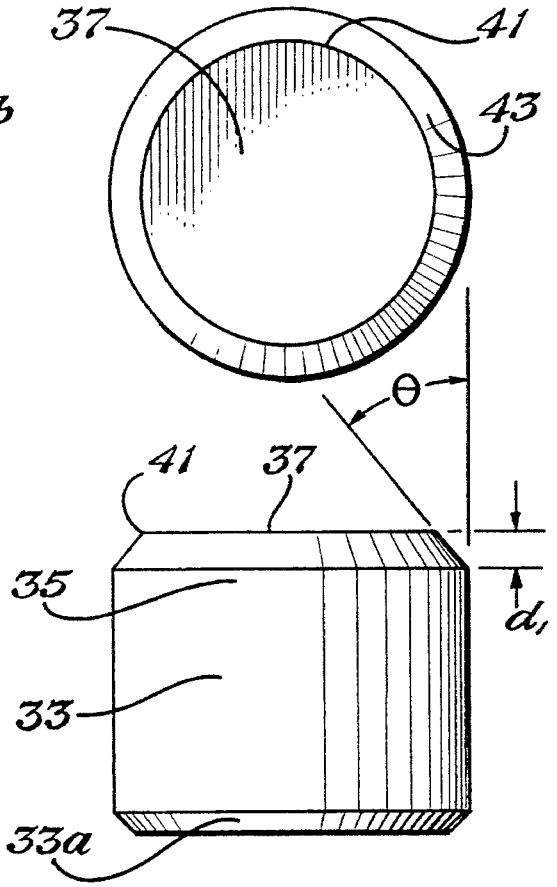
FIG. 3 is an enlarged, plan, and side elevation view of an embodiment of the gage insert of the present invention.

Referring now to FIGS. 2 and 3, enlarged plan and side elevation views of two embodiments of the gage insert of the present invention are shown. Each insert 31 has a generally cylindrical insert body 33, formed of a hard, fracture-tough material such as cemented tungsten carbide or the like. The gage insert 31 has a cutting end 35 having a substantially flat, wear-resistant face 37 formed thereon. The face 37 is substantially normal to the longitudinal axis of the gage insert 31. The cutting end 35 of the gage insert 31 is formed of a layer of a super-hard, abrasion-resistant material such as polycrystalline diamond (PCD), thermally stable polycrystalline diamond (TSP), cubic boron nitride (CBN), or the like. It is at least theoretically possible to fabricate cemented carbide materials having adequate hardness and abrasion resistance for use in the cutting end 35 of the invention in certain geological formations, but PCD, TSP, and CBN are the only materials presently economically available that are thought to be adequate for use in the cutting end 35 for a wide variety of geological formations. The layer comprising the cutting end 35 of the gage insert 31 may be affixed to the body 33 of the insert 31 by brazing, sintering the two materials together, or other methods conventional in the art. The end of the insert body 33 opposite the cutting end has a small bevel **33*a* formed thereon to facilitate insertion of the insert 31 into the mating hole in the surface of the cutter 15**.

At least one cutting edge 41, **41*a*, 41*b* is formed on the cutting end 35 of the gage insert 31. This cutting edge 41, 41*a*, 41*b* may be formed by beveling the circumference of the cutting end 35. Because the cutting end is formed of the super-hard, abrasion-resistant material, likewise the cutting edge 41 also is formed of the super-hard, abrasion-resistant material. It has been found that the cutting edge 41, 41*a*, 41*b* must be formed of a super-hard, abrasion-resistant material for the proper function of the improved gage insert 31. If the cutting edge 41, 41*a*, 41*b* is formed of a softer or less abrasion-resistant material, the cutting edge rapidly will become blunted, and the gage insert 31 will cease to perform effectively as a shear-cutting insert. A blunted cutting edge 41 is equivalent to prior-art inserts having radiused or sharp-cornered edges. Prior-art PCD flush-mounted inserts are susceptible to heat-cracking and spalling because of excessive friction and heat buildup, and such inserts are incapable of the desirable shear-cutting action of the gage insert 31** of the present invention.

FIG. 2 illustrates an embodiment of the gage insert 31 of the present invention having two cutting edges **41*a*, 41*b*. One of the cutting edges 41*b* is formed by the intersection of a circumferential bevel 43 and the face 37 on the cutting end 35 of the insert 31. The other cutting edge 41*a* is formed by the intersection of a flat or planar bevel 45, the face 37, and the circumferential bevel 43, defining a chord across the circumference of the generally cylindrical gage insert 31. FIG. 3 illustrates an embodiment of the gage insert 31 of the present invention having a single continuous circumferential cutting edge 41 formed by the intersection of a bevel 43 about the circumference of the cutting end 35 of the gage insert 31**.

Figure 4:
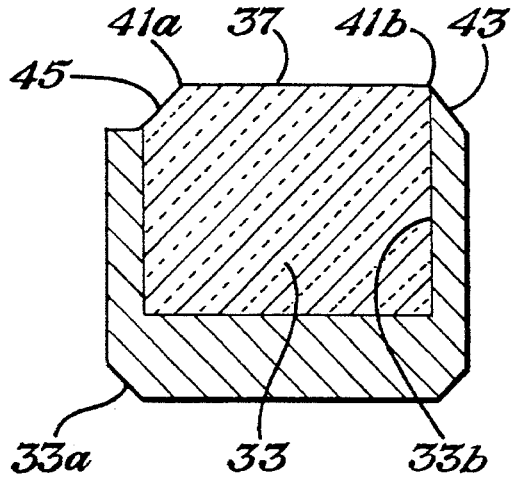
FIG. 4 is an enlarged, longitudinal section of a gage insert in accordance with the present invention.

FIG. 4 shows yet another embodiment of the gage insert of the present invention. In this embodiment, the cutting end 35 of the insert 31 is a cylinder of super-hard, abrasion-resistant material. The body 33 of the insert 31 is a cylinder of hard, fracture-tough material, having a cylindrical socket **33*b* enclosing the cutting end cylinder 35. Such an insert may be formed by sintering the two materials together, brazing the cutting end 35 into the socket 33*b* of the insert body 33, or other methods known in the art. A planar bevel 45 is formed on the cutting end 35 of the gage insert 31, intersecting the face 37 of the cutting end 35 to define a first cutting edge 41*a*. The first cutting edge 41*a* thus is formed of the super-hard, abrasion-resistant material of the cutting end cylinder 35. A second cutting edge 41*b* is formed by the intersection of a circumferential bevel 43 about the body of the insert and the face 37 of the cutting end 35. The second cutting edge 41*b*** thus is formed of the hard, fracture-tough material.

It will be appreciated that a variety of cutting edges formed of materials having various mechanical properties may be formed on a gage insert in accordance with this invention. Apart from the number and composition of the cutting edges 41, **41*a*, 41*b*, the dimensions of the bevels that define the cutting edges are of significance in the proper operation of the gage insert 31 of the present invention. For reasons that will become apparent in the discussion of the operation of the invention, the bevel angle $\theta$ is of importance. It has been found that a bevel angle $\theta$ of 45 degrees functions ,quite satisfactorily. Likewise, the depth and width of the of the bevel 43, 45 are important to the proper function of the gage insert 31. It has been determined that a bevel depth d1 of at least 0.010 inch, in combination with a bevel angle θ of 45 degrees, produces a satisfactorily functioning gage insert. Because the bevel angle θ is 45 degrees, the depth d1 and width of the bevel are the same. For another bevel angle θ, the depth d1 and width would not be equal, but the bevel depth d1 should be selected to be at least 0.010 inch. The bevel described herein should be distinguished from bevels formed by standard manufacturing operations such as "breaking sharp edges or corners." The bevel resulting from such operations typically resembles a radius, and therefore is not capable of forming the cutting edge 41** of the present invention.

Figure 5:
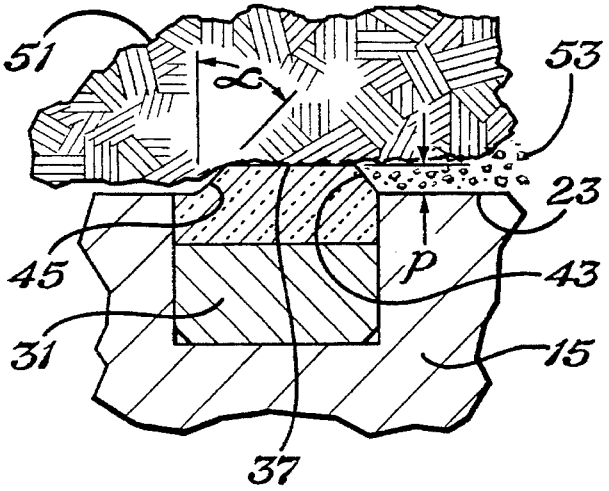
FIG. 5 is an enlarged, fragmentary view, in longitudinal section, of a gage insert of the present invention in shear-cutting engagement with the sidewall of the borehole.

FIG. 5 illustrates, in longitudinal section, an embodiment of the gage insert 31 in operation. The geometry and dynamics of the cutting action of earth-boring bits is extremely complex, but the operation of the gage insert 31 of the present invention is believed to be similar to that of a metal-cutting tool. As the cutter 15 rotates along the bottom of the borehole, the gage surface 23 of each cutter 15 comes in proximity to the sidewall 51 of the borehole. Because the gage surface 23 is proximal to the sidewall 51 of the borehole, the protruding gage insert 31 contacts the sidewall 51 of the borehole. The cutting edge 41 of the gage insert 31 shearingly cuts into the material of the sidewall 51 of the borehole. The bevel 45 serves as a cutting or chip-breaking surface that causes shear stress in the material of the borehole sidewall 51, thus shearing off fragments or chips 53 of the borehole material. The substantially flat face 37 of the insert 31 remains at least partially in contact with the sidewall 51 of the borehole, and thus is subject to abrasive wear during operation. Wear-resistance of the face 37 is enhanced because the surface area of the face 37 that is in contact with the sidewall is maximized (the area is very nearly equal to the cross-sectional area of the generally cylindrical insert body 33). An insert design having a smaller contact surface area of the face 37 would not have adequate wear-resistant characteristics.

Significant in the proper operation of the gage inserts 31 of the present invention are the dimensions of the cutting edge 41, 41*a*, 41*b* and bevel 43, 45. In cutting the sidewall 51 of the borehole, the bevel angle θ defines a rake angle α with respect to the portion of the borehole sidewall 51 being cut. It is believed that the rake angle α must be negative (such that the cutting surface leads the cutting edge 41) to avoid high friction and the resulting heat buildup, which can cause rapid failure of the gage insert 31. The bevel angle θ, which defines and is equal to, the rake angle α, may be chosen from a range between 0 and 90 degrees. The choice of bevel and rake angles θ, α depends upon the cutting action desired: at a high rake angle α (90degrees, for instance), there is no cutting edge, and thus no shearing action; at a low rake angle α (0 degrees, for instance) shearing action is maximized, but is accompanied by high friction and transient shock loading of the insert 31, which can cause insert failure. It is believed that an intermediate rake angle, in the range between 15 and 60 degrees, provides a satisfactory compromise between the cutting action of the insert 31 and insert operational life.

Again, because the cutting dynamics of rolling cone earth-boring bits are complicated, the exact cutting action of the gage insert 31 is not fully understood. It is believed that providing an at least partially circumferential cutting edge (41 and 41*b* in FIGS. 2 and 3) having a circumferential bevel 43 will permit the cutting edge 41, 41*b* to shearingly contact the sidewall 51 of the borehole notwithstanding geometric peculiarities of the earth-boring bit design or of the borehole being drilled. Providing a planar cutting edge 41*a*, in addition to the partially circumferential cutting edge 41*b*, is thought to provide a more efficient cutting edge at a point on the insert 31 that is believed to contact the sidewall of the borehole 51 most frequently. Such a planar cutting edge is believed to be more effective at removing borehole sidewall 51 material (i.e. takes a bigger bite) than other types of edges.

The face 37 of the insert 31 should extend a distance p from the gage surface 23 during drilling operation. Such protrusion enhances the ability of the cutting edge 41, 41*a*, 41*b*, to shearingly engage the borehole sidewall 51. During drilling operation in abrasive formations, the gage surface 23 will be eroded away, increasing any distance p the face 37 protrudes or extends form the gage surface 23. If the cutting face 37 extends much further than 0,075 inch from the gage surface 23, the insert 31 may experience an unduly large bending stress, which may cause the insert 31 to break of fail prematurely. Therefore, the face 37 should not extend a great distance p from the gage surface 23 at assembly and prior to drilling operation. The face may be flush with the gage surface 23 at assembly, or preferably extends a nominal distance p of between 0.015 and 0.030 inch, for most bits.

At least one cutting edge 41, 41*a*, 41*b*, of the gage insert 31 must be formed of the super-hard, abrasion-resistant material (as discussed above) to prevent the cutting edge from rapidly being eroded by the abrasive materials encountered in the borehole. It has been found that gage inserts formed of softer materials cannot maintain the cutting edge 41, 41*a*, 41*b*, required for the operation of the gage insert 31 of the present invention. Provision of an insert body 33 formed of a hard, fracture-tough material such as cemented tungsten carbide provides a shock absorbing mass to absorb the shock loads that the super-hard, abrasion-resistant material is incapable of sustaining by itself.

Figure 6:
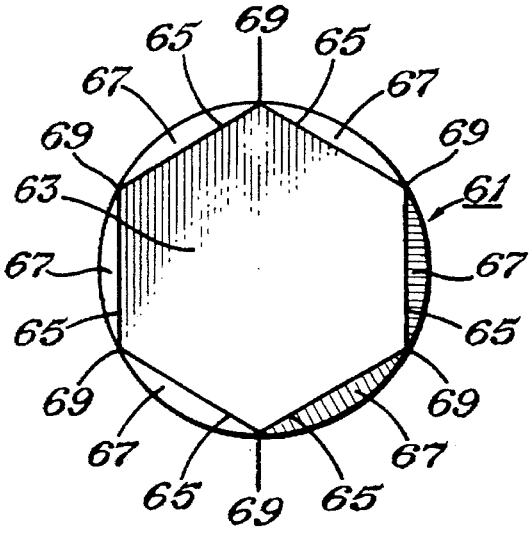
FIG. 6 is an enlarged plan view of a gage insert according to another embodiment of the present invention.
Figure 7:
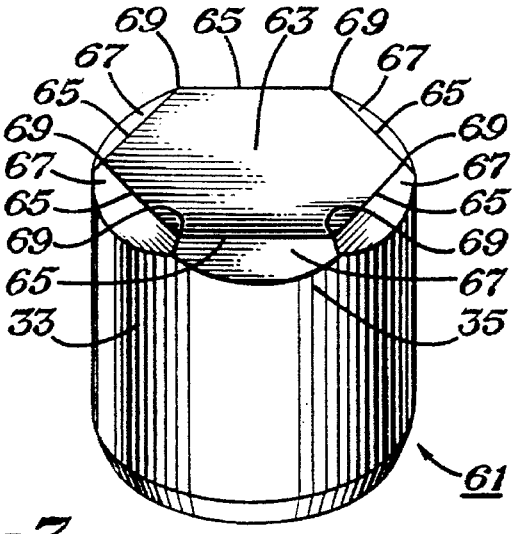
FIG. 7 is a perspective view of the gage insert of FIG. 6.

FIGS. 6 and 7 are plan and perspective views, respectively, of a gage insert 61 according to another embodiment of the present invention. Like the embodiments described with reference to FIG. 2 and 3, insert 61 includes a generally cylindrical body 33 formed of hard, fracture-tough material, and a cutting end 35 formed of super-hard, abrasion resistant material. Cutting end 35 of insert 61 is provided with a polygonal face 63, which is substantially normal to the longitudinal axis of insert 61.

Polygonal face 63 has at least two sides that define at least a pair of cutting edges 65. In the embodiment illustrated in FIG. 6 and 7, polygonal face 63 is hexagonal and defines six cutting edges 65. Six cutting surfaces 67 or bevels connect each side or cutting edge 65 defined by polygonal face 63 with cutting end portion 35 of cylindrical body 33. Like the embodiments illustrated in FIGS. 2 and 3, cutting surfaces 67 extend at a selected angle to define a negative rake angle with respect to the sidewall of the borehole being sheared. The same angular and dimensional constraints described with reference to the embodiments shown in FIGS. 2 and 3 apply to cutting surfaces Polygonal face 63, cutting edges 65, cutting surfaces 67, and plow edge 69 are formed by grinding or electrical discharge machining (EDM) a commercially available wafer of super-hard, abrasion-resistant material. Alternately, these could be integrally formed during formation of the super-hard, abrasion-resistant material itself.

Cutting edges 65 and cutting surfaces 67 intersect one another to define at least one, in this case six, plow edges 69. Plow edges 69 have a reduced area of contact with the sidewall of the borehole, increasing the ability of gage insert 61 to shear formation material from the sidewall of the borehole. Additionally, each cutting surface 67 recedes from plow edge 69 to provide an area or clearance for chip formation and removal.

Due to the relatively small protrusion of the cutting end of the insert, only a small amount of material can be displaced up the cutting surface as shavings. At greater depths of cut or higher penetration rates the majority of the material has to be disposed laterally into the open space adjacent the insert to maintain an effective shearing action and to avoid unproductive clogging. The combination of a plow edge and inclined cutting surfaces is a very effective, streamlined geometry to shear the formation and laterally displace it.

Figure 8:
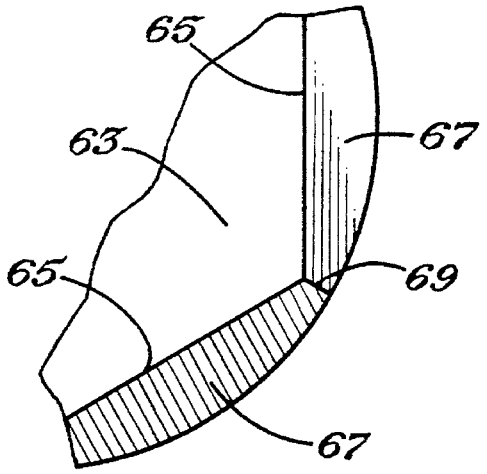
FIGS. 8–10 are enlarged, fragmentary plan views of a portion of three gage inserts according to the present invention.
Figure 9:
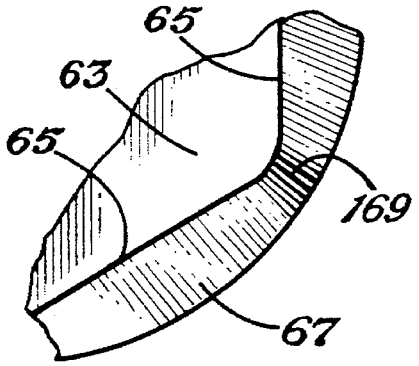
Figure 10:
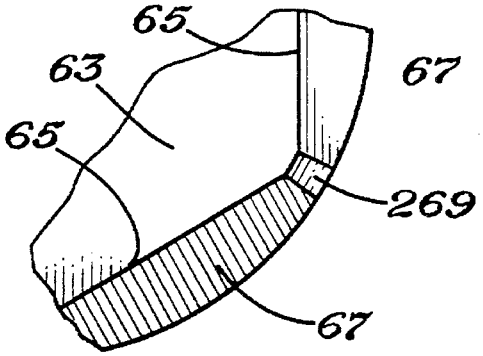

FIGS. 8 through 10 are enlarged, fragmentary, plan views of varying configurations of plow edges 69, 169, 269 according to the present invention. FIG. 8 illustrates a plow edge 69 formed by a sharp intersection of cutting surfaces 67, wherein plow edge 69 can be characterized as a sharp corner or edge. FIG. 8 illustrates a plow edge 169 formed by a radius at the intersection of cutting surfaces 67. FIG. 10 depicts a plow edge 269 that comprises a flat or chamfer formed at the intersection of cutting surfaces 67. All of these edge configurations are contemplated by the present invention, and one may be preferable to another depending on other bit design considerations.

Figure 11:
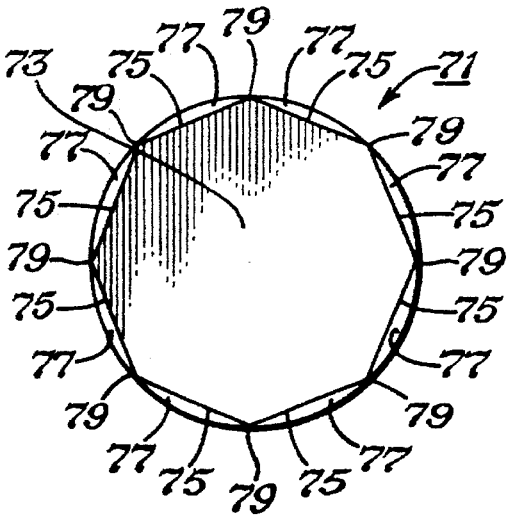
FIG. 11 is a plan view of a gage insert according to another embodiment of the present invention.

FIG. 11 is a plan view of a gage insert 71 according to the present invention that is generally similar to that illustrated in FIG. 6, except polygonal face 73 is octagonal, and thus provides eight sides or cutting edges 75 and defines eight cutting surfaces 77 and eight plow edges 79.

It has been found that gage inserts similar to the embodiment illustrated with reference to FIG. 3 (having a single circular edge 41 and conical cutting surface 43) form chips that erode cutter shell material on the gage surface in FIG. 1) adjacent to and surrounding the gage insert. It is believed that a gage insert 61, 71 according to the present invention having at least one plow edge 69, 79 oriented where cutter shell erosion normally would occur will prevent severe cutter shell erosion adjacent the inserts because cutting surfaces 67, 77, which diverge from plow edges 69, 79 provide a clearance area for formation and lateral removal of chips during cutting. Provision of a gage insert 61, 71 with a plurality of plow edges 69, 79, i.e. six or eight, reduces the margin of error in orienting a plow edge 69, 79 where it will be most effective.

Gage inserts 61, 71 operate similarly to those described with reference to FIGS. 1–5, but with added efficiency due to the ability of reduced-area plow edges 69, 79 to increase the contact stress induced in formation material at the sidewall of the borehole and to provide an area for formation and removal of chips generated by the shear-cutting action of the inserts.

Figure 12:
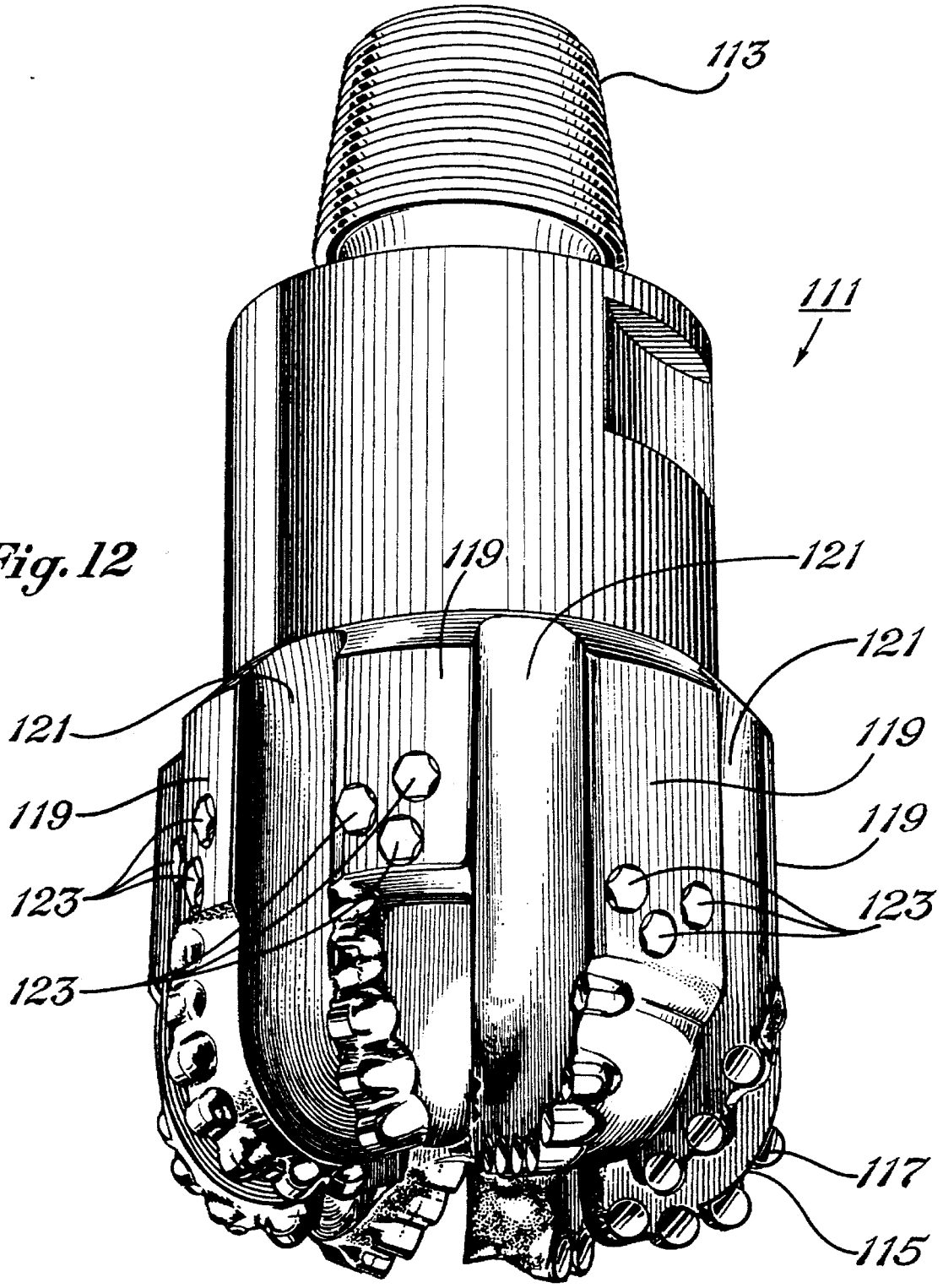
FIG. 12 is a perspective view of an earth-boring bit of the fixed cutter variety that embodies the gage inserts according to the present invention.

FIG. 12 is a perspective view of an earth-boring bit 111 of the fixed cutter variety embodying the present invention. Bit 111 is threaded 113 at its upper extent for connection into a drillstring. A cutting end 115 at a generally opposite end of bit 111 is provided with a plurality of diamond or hard metal cutters 117, arranged about cutting end 115 to effect efficient disintegration of formation material as bit 111 is rotated in a borehole. A gage surface 119 extends upwardly from cutting end 115 and is proximal to and contacts the sidewall of the borehole during drilling operation of bit 111. A plurality of channels or grooves 121 extend from cutting end 115 through gage surface 119 to provide a clearance area for formation and removal of chips formed by cutters 117.

A plurality of gage inserts 123 are provided on gage surface 119 of bit 111. Gage inserts 123 are formed as illustrated with reference to FIGS. 2–11 and area subject to the same dimensional considerations described above with reference to those figures. Active, shear cutting gage inserts 123 on gage surface 119 of bit 111 provide the ability to actively shear formation material at the sidewall of the borehole to provide improved gage-holding ability in earth-boring bits of the fixed cutter variety. Bit 111 is illustrated as a PDC ("polycrystalline diamond cutter") bit, but inserts 123 are equally useful in other fixed cutter or drag bits that include a gage surface for engagement with the sidewall of the borehole.

An advantage of the improved gage insert of the present invention is that earth-boring bits equipped with such inserts have both superior gage-holding ability and superior longevity and rates of penetration.

Although the invention has been described with reference to specific embodiments, it will be apparent to those skilled in the art that various modifications may be made without departing from the scope of the invention described herein.

We claim:

1. In an earth-boring bit of the fixed-cutter variety including a gage surface proximal to a sidewall of a borehole as the bit rotates about its axis, the gage surface having a plurality of gage inserts secured in sockets formed in the gage surface, an improved gage insert comprising:

an elongated cylindrical body secured in an aperture in the gage surface, the body formed of a hard, fracture-tough material;

a cutting end adapted to extend, during drilling operation, a selected distance from the gage surface, the cutting end formed of a super-hard, abrasion-resistant material, the cutting end having a face substantially normal to a longitudinal axis of the body;

at least one cutting surface connecting the face and body of the insert at a selected angle to define a cutting edge to shear the sidewall of the borehole; and the selected angle of the cutting surface defining a negative rake angle with respect to the sidewall of the borehole being sheared.

2. The gage insert according to claim 1 wherein the cutting end of the insert projects at least 0.015 inch from the gage surface during drilling operation.

3. The gage insert according to claim 1 further comprising three pairs of cutting surfaces, each surface of each pair of cutting surfaces intersecting another of the pair of surfaces to define six plow edges.

4. The gage insert according to claim 1 wherein the face is polygonal and the cutting surface further comprises four pairs of cutting surfaces, each surface of each pair of cutting surfaces intersecting another of the pair of surfaces to define eight plow edges.

5. The gage insert according to claim 4 wherein the plow edge is a radius at the intersection of the pair of cutting surfaces.

6. The gage insert according to claim 4 wherein the plow edge is a sharp edge at the intersection of the pair of cutting surfaces.

7. The gage insert according to claim 4 wherein the plow edge is a flat surface at the intersection of the pair of cutting surfaces.

8. The gage insert according to claim 1 wherein the super-hard, abrasion-resistant material is polycrystalline diamond.

9. The gage insert according to claim 1 wherein the hard, fracture-tough material is cemented tungsten carbide.

10. The gage insert according to claim 1 wherein the cutting edge is arcuate and the cutting surface is generally conical and circumferential.

11. In an earth-boring bit of the fixed cutter variety including a gage surface proximal to a sidewall of a borehole as the bit rotates about its axis, the gage surface having a plurality of gage inserts secured in sockets formed in the gage surface, an improved gage insert comprising:

an elongated cylindrical body inserted in an aperture in the gage surface, the body formed of a hard, fracture-tough material;

a cutting end protruding a selected distance from the gage surface, the cutting end formed of a super-hard, abrasion-resistant material, the cutting end having a substantially flat, polygonal face substantially normal to a longitudinal axis of the body, the polygonal face having a plurality of sides, each side defining a cutting edge;

a plurality of cutting surfaces connecting the sides of the polygonal face to the body of the insert at a selected angle to shear the sidewall of the borehole, at least two of the cutting surfaces intersecting one another to define a plow edge; and the selected angle of each cutting surface defining a negative rake angle with respect to the sidewall of the borehole being sheared.

12. The gage insert according to claim 11 wherein the cutting end of the insert projects at least 0.015 inch from the gage surface during drilling operation.

13. The gage insert according to claim 11 wherein the polygonal face is a hexagon that defines six cutting edges, six cutting surfaces, and six plow edges.

14. The gage insert according to claim 11 wherein the polygonal face is an octagon that defines eight cutting edges, eight cutting surfaces, and eight plow edges.

15. The gage insert according to claim 11 wherein the plow cutting edge is a radius at the intersection of the cutting surfaces.

16. The gage insert according to claim 11 wherein the plow edge is a sharp edge at the intersection of the pair of cutting surface.

17. The gage insert according to claim 11 wherein the plow edge is a flat surface generally at the intersection of the pair of cutting surface.

18. The gage insert according to claim 11 wherein the super-hard, abrasion-resistant material is polycrystalline diamond.

19. The gage insert according to claim 11 wherein the hard, fracture-tough material is cemented tungsten carbide.

20. In an earth-boring bit of the fixed cutter variety including a gage surface proximal to a sidewall of a borehole as the bit rotates about its axis, the gage surface having a plurality of gage inserts secured in sockets formed in the gage surface, an improved gage insert comprising:

an elongated cylindrical body inserted in an aperture in the gage surface, the body formed of a hard, fracture-tough material;

a cutting end protruding a selected distance from the gage surface, the cutting end formed of a super-hard, abrasion-resistant material, the cutting end having a substantially flat, abrasion-resistant face substantially normal to a longitudinal axis of the body;

a generally conical, circumferential cutting surface connecting the face to the body of the insert at a selected angle to define a circumferential cutting edge to shear the sidewall of the borehole; and the cutting surface defining a negative rake angle with respect to the sidewall of the borehole being sheared.

21. The gage insert according to claim 20 wherein the cutting end of the insert projects at least 0.015 inch from the gage surface during drilling operation.

22. The gage insert according to claim 20 wherein the cutting end of the insert projects at least 0.015 inch from the gage surface during drilling operation.

23. The gage insert according to claim 20 wherein the hard, fracture-tough material is tungsten carbide.

24. The gage insert according to claim 20 wherein the super-hard, abrasion-resistant material is polycrystalline diamond.

* * * * *